US006434887B2

(12) United States Patent
Nakanishi et al.

(10) Patent No.: US 6,434,887 B2
(45) Date of Patent: Aug. 20, 2002

(54) WINDOW STAY AND WINDOW CONSTRUCTION EQUIPPED WITH WINDOW STAY

(75) Inventors: Yoshikazu Nakanishi, Tokyo; Kenkichi Matsubara, Yokohama, both of (JP)

(73) Assignee: Nakanishi Engineering Co., Ltd. (JP)

( * ) Notice: Subject to any disclaimer, the term of this patent is extended or adjusted under 35 U.S.C. 154(b) by 0 days.

(21) Appl. No.: 09/734,267

(22) Filed: Dec. 11, 2000

(30) Foreign Application Priority Data

Dec. 10, 1999 (JP) ..... 11-351936

(51) Int. Cl.[7] ..... E05D 15/28
(52) U.S. Cl. ..... 49/246
(58) Field of Search ..... 49/246, 247, 248, 49/249; 16/369, 370, 371

(56) References Cited

U.S. PATENT DOCUMENTS 4,364,201 A * 12/1982 Taylor ..... 19/248
4,622,715 A * 11/1986 Buckley ..... 16/370
4,674,149 A * 6/1987 Vetter ..... 16/341
4,833,754 A * 5/1989 Yang ..... 16/339
5,255,471 A * 10/1993 Shaw et al. ..... 49/252
5,711,052 A * 1/1998 Delaske ..... 16/364
5,898,977 A * 5/1999 Muir ..... 16/363

FOREIGN PATENT DOCUMENTS

EP 573151 A1 12/1993
GB 2215775 9/1989

* cited by examiner

*Primary Examiner*—Jerry Redman
(74) *Attorney, Agent, or Firm*—Adams & Wilks

(57) ABSTRACT

A window stay is provided for mounting a window in a window frame. The window stay comprises a bar member for connection to the window, a track member for connection to the window frame, a slide member slidably mounted on the track member, and a pair of arms for moving the bar member to a closed position and to an open position. The pair of arms comprise a first arm connecting the track member to the bar member and a second arm connecting the bar member to the slide member so that the bar member overlies the track member in the closed position and is slidingly moved away from the track member in the open position. A projection is disposed on the bar member and has a side surface extending in a longitudinal direction of the bar member. An insert groove is formed at an end portion of the track member for receiving the projection when the bar member is in the closed position. The insert groove has a guide wall for guiding the projection into the insert groove and a side surface extending in a longitudinal direction of the track member.

25 Claims, 5 Drawing Sheets

WINDOW STAY AND WINDOW CONSTRUCTION EQUIPPED WITH WINDOW STAY

BACKGROUND OF THE INVENTION (1) Field of the Invention

The present invention relates generally to window stays and, more particularly, to a window stay for mounting a casement window in a window frame so that the casement window can be opened and closed and slide to and from the window frame. The present invention also relates to a window construction equipped with the window stay.

(2) Background Information

A window system has been known wherein a window is mounted in a window frame via a stay so that when the window is opened, the window can revolve about a hinge axis, rotate about its own axis and slide outwardly relative to the window frame. In this window system, as shown in, for example, FIG. 4, a window 3 is mounted on a window frame 1 via upper and lower stays 2*a*, 2*b*. The structures of the stays 2*a*, 2*b* are essentially the same though there are differences as noted hereinbelow.

FIG. 5 shows an example of the stay 2*b* disposed at the lower portion of the window. The stay 2*b* has a track member 4 mounted on the window frame 1, a bar member 5 mounted on the window 3, and a slide member 6 slidably mounted in a groove formed on the track member 4. A first arm 8 is pivotally mounted on a pivot 7 at one end of the track member 4, and the top end of the first arm 8 is pivotally mounted at the intermediate portion of the bar member 5 by means of a pivot 9. A second arm 12 is pivotally mounted on a pivot 11 at a top end 10 of the bar member 5. The second arm 12 is pivotally mounted on the slide member 6 by means of a pivot 13. Between the slide member 6 and the intermediate portion of the first arm 8, a third arm 14 is pivotally mounted by means of pivots 15, 16. Further, between the intermediate portion of the third arm 14 and the intermediate portion of the bar member 5, a fourth arm 17 is pivotally mounted by means of pivots 18, 19.

In the above structure, when the window 3 mounted on the bar member 5 is moved from the window frame 1 toward the open position, the bar member 5 is rotated by the actions of the arms 8, 12, 14 and 17 to the position at which the slide member 6 abuts a stopper 20 disposed on the track member 4.

When the window 3 is rotated from the open position toward the window frame 1, the slide member 6 is moved by the actions of the arms 8, 12, 14 and 17 in a direction such that it moves away from the stopper 20 of the track member 4, and the window 3 can be closed.

When the window 3 is closed, the track member 4 and the bar member 5 are overlaid to each other in such a state that the arms are collapsed. At this time, a drawing mechanism for securely drawing the window 3 is provided. As the drawing mechanism, in the conventional stay shown in FIG. 5, at the top end 10 of the bar member 5, a projection portion 21 which projects eccentrically toward the track member 4 and a sloping surface 22 are provided. On the other hand, an end cap 25 is mounted at the end portion of the track member 4. The end cap 25 has a sloping surface 23 which corresponds to the projection portion 21 and the sloping surface 22, and a recess 24 which inclines toward one side. When the window 3 is closed, the top end 10 of the bar member 5 moves in a direction of an arrow A, the projection portion 21 and the sloping surface 22 are guided by the sloping surface 23 of the end cap 25 formed in the track member 4, and the projection portion 21 enters the recess 24. At this time, the window 3 can be drawn toward the window frame 1 by the shapes of the sloping surfaces.

In the window stay having the structure as shown in FIG. 5, when the top end 10 of the bar member 5 is engaged with the end cap 25 of the track member 4, if it is further attempted to displace the top end 10 in the recess 24, the projection portion 21 abuts the side wall which constitutes the recess 24 and the bar member 5 can not be moved further. Namely, it is possible to engage the top end 10 of the bar member 5 only from the sloping surface 23 which slants toward one side of the end cap 25. Accordingly, the shapes of the top ends 10 of the bar member 5 and the shapes of the end caps 25 of the track member 4 are different for the stay 2*a* and the stay 2*b* of the upper and lower sides of the window 3 in that they are symmetrical to one another. Therefore, it is required to prepare separate window stays for the upper and lower sides of the window 3. Further, when the right and left sides of the window are to be mounted to the window frame with stays, it is also necessary to use right and left stays of different structures for the same reason.

Moreover, a stay has been known wherein the top end of the bar member is formed into a V-shape in which the projection portion is on the center line, and the end cap of the track member is formed into a V-shape in which the center part is deeply recessed so that the top end may fit to the end cap.

However, with the stay having a bar member with a V-shaped top end and a track member with a V-shaped end cap, since the top end of the bar member is not securely supported, its deflection is large and the window can not be tightly closed. In addition, when the window is opened or closed, since the top end of the bar member moves freely, the top end abuts the end cap and jams with it, whereby the window may become locked as the window remains slightly open.

A stay has been proposed wherein the pivoting axis of the link constituting the stay is offset to one side from the center line so that the link rotates in one direction, whereby the opening and closing of the window can be made smoothly. However, in such a stay, depending upon the offset state, the link can rotate in either of clockwise and counterclockwise directions. Accordingly, in such a stay, it is required to change the upper and lower or right and left structures depending upon the site where it is to be used.

SUMMARY OF THE INVENTION

It is an object of the present invention to provide a window stay for mounting a window on a window frame so that when the window is opened or closed, the window can be pivoted to open and closed positions and also rotated about an axis thereof. According to the present invention, the window stay has a drawing mechanism which can be selectively connected at upper and lower or right and left positions of the window.

Another object of the present invention is to provide a window stay useful at any one of the upper and lower or right and left positions of the window so that the window can be opened and closed smoothly without resulting in a locked state.

Another object of the present invention is to provide a window construction equipped with a pair of window stays according to the present invention for adjustably mounting a window in a window frame.

The foregoing and other objects of the present invention are carried out by a window stay comprising a track member for connection to a window frame, a bar member for connection to a window, a slide member slidably mounted on the track member, a first arm for connecting the track member to the bar member and a second arm for connecting the bar member to the slide member. The first and second arms move the bar member to a closed position where the bar member overlies the track member or to an open position where the bar member is slidingly moved away from the track member. An engaging projection is disposed at a central part of an upper end of the bar member. An insert groove is formed at a central part of an end portion of the track member for receiving the engaging projection when the bar member is moved to the closed position. A guide wall is formed at a front portion of the insert groove for guiding the engaging projection into the insert groove.

According to the present invention, a receiving member is mounted at the end portion of the track member and has the guide wall which widens in a transverse direction. A control arm is disposed between the second arm and the slide member for restricting an opening angle of the second arm. Preferably, the engaging projection has a side surface extending in a longitudinal direction of the bar member, and the insert groove has a side surface extending in a longitudinal direction of the track member.

In another aspect, the present invention is directed to a window construction comprising a window, a window frame, and a pair of window stays according to the present invention for adjustably mounting the window in the window frame.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 3(A) is an explanatory view corresponding to the embodiment shown in FIG. 1 and FIG. 3(B) is an explanatory view showing another example corresponding to another embodiment;

DETAILED DESCRIPTION OF THE PREFERRED EMBODIMENTS

While this invention is susceptible of embodiments in many different forms, this specification and the accompanying drawings disclose several examples of the use of the invention. The invention is not intended to be limited to the embodiments so described, and the scope of the invention will be pointed out in the appended claims.

Figure 1:
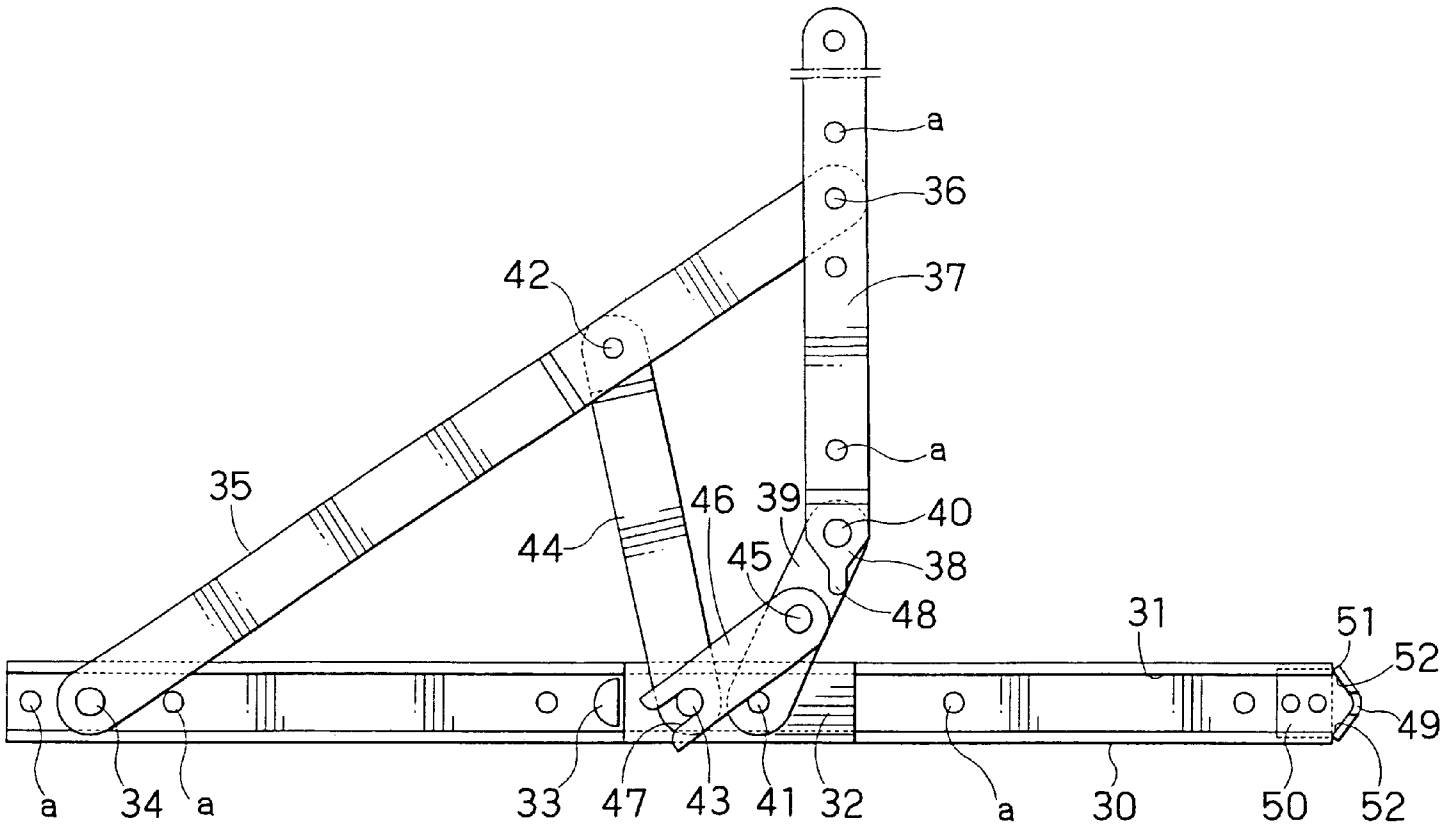
FIG. 1 is a plane view showing an embodiment of a window stay according to the present invention in a state where the window is opened and the bar member is slidingly moved to the open position.
Figure 2:
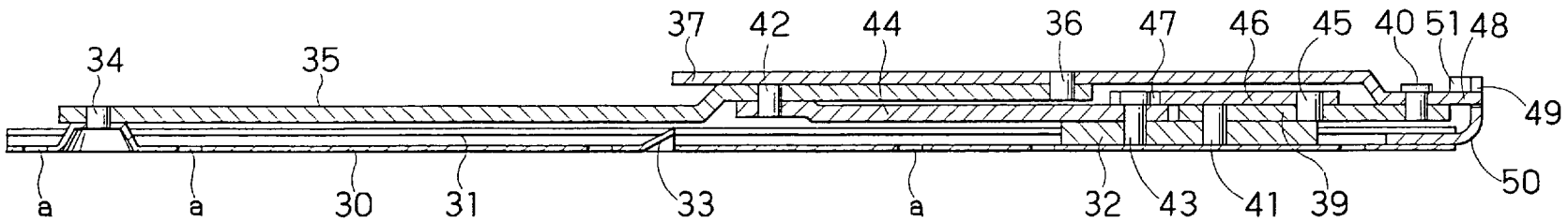
FIG. 2 is a sectional view of the window stay shown in FIG. 1 showing a state where the window is closed and the bar member overlies the track member.

FIG. 1 and FIG. 2 show an embodiment of a window stay according to the present invention. In these figures, a track member 30 which is to be mounted on a window frame by passing bolts (not shown) through mounting apertures "a" is substantially C-shaped in cross section and has a sliding groove 31 which extends in a longitudinal direction. A slide member 32 is mounted on the sliding groove 31 for undergoing sliding movement in an axial direction to the position where the slide member abuts a stopper 33 formed within the sliding groove 31.

A first arm 35 has one end pivotally mounted to an end of the track member 30 by means of a pivot 34. Another end of the first arm 35 is pivotally mounted on an intermediate portion of a bar member 37 by means of a pivot 36. A second arm 39 has one end pivotally mounted to a top end 38 of the bar member 37 by means of a pivot 40. Another end of the second arm 39 is pivotally mounted on the slide member 32 by means of a pivot 41. A window is mounted to the bar member 37 by passing bolts through mounting apertures a.

Between the first arm 35 and the slide member 32, a third arm 44 is pivotally mounted by means of pivots 42, 43. Further, a control arm 46 is pivotally mounted on a pivot 45 disposed at an intermediate portion of the second arm 39. An engaging groove 47 which slidably engages with the pivot 43 is formed at the top end of the control arm 46. In an alternative embodiment, the control arm 46 may be pivotally mounted on the pivot 43 and the engaging groove 47 may be formed at the pivot 45 side.

By the first and second arms 35, 39, the bar member 37 can be moved to the closed position (FIG. 2) where it overlies the track member 30, and to the open position (FIG. 1) where it slidingly moves away from the track member 30. At the position shown in FIG. 1, since the pivot 43 abuts the base of the engaging groove 47, the second arm 39 cannot be rotated counterclockwise and movement of the bar member 37 is thereby restricted.

Figure 3:
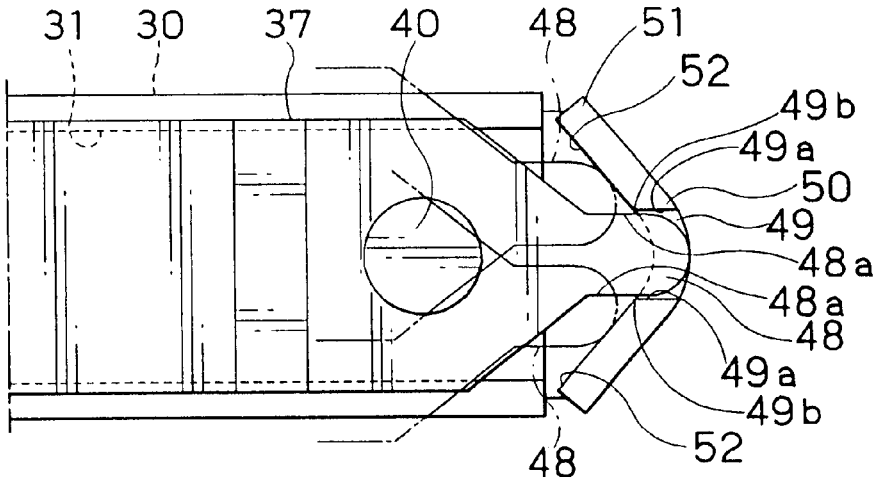
FIGS. 3(A) and 3(B) are explanatory views showing the relationship between the engaging projection and the insert groove, where
Figure 3:
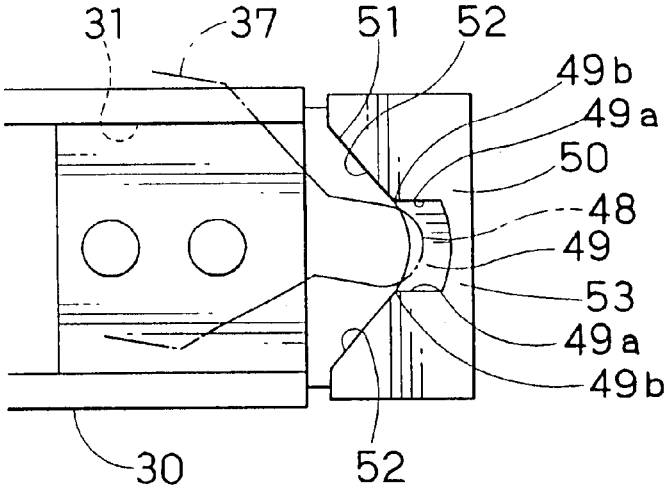
Figure 4:
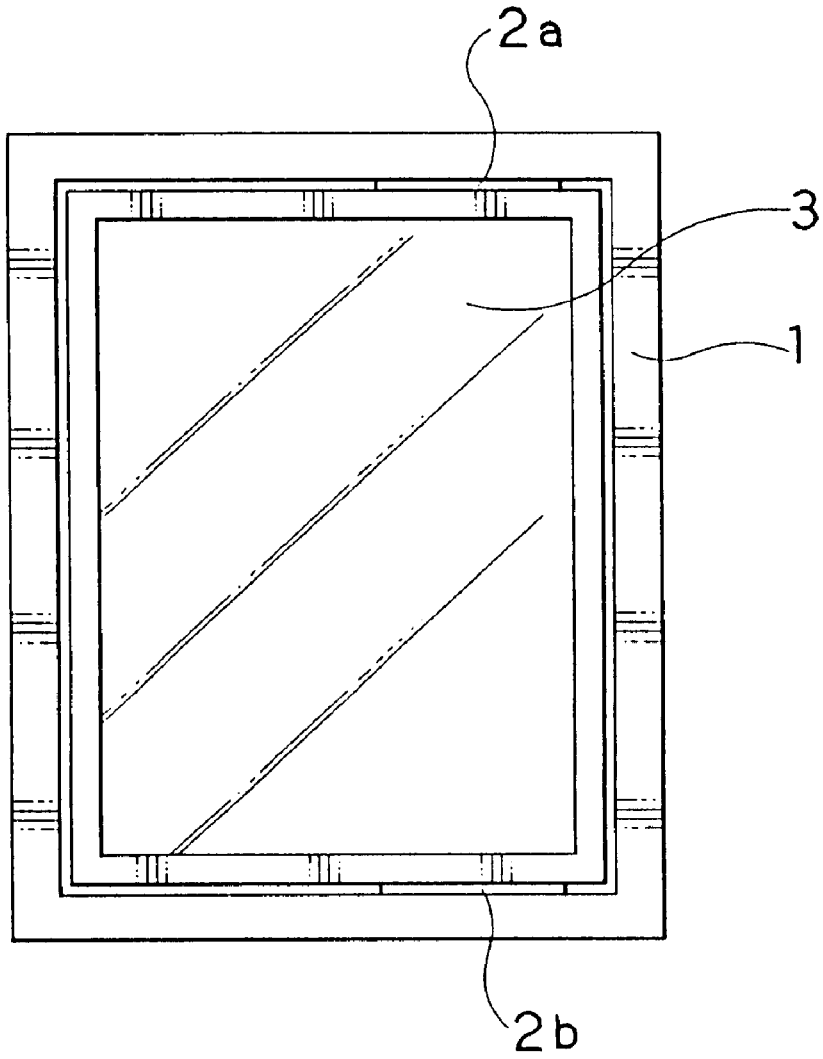
FIG. 4 is a front view showing the relationship between the window and the window frame.
Figure 5:
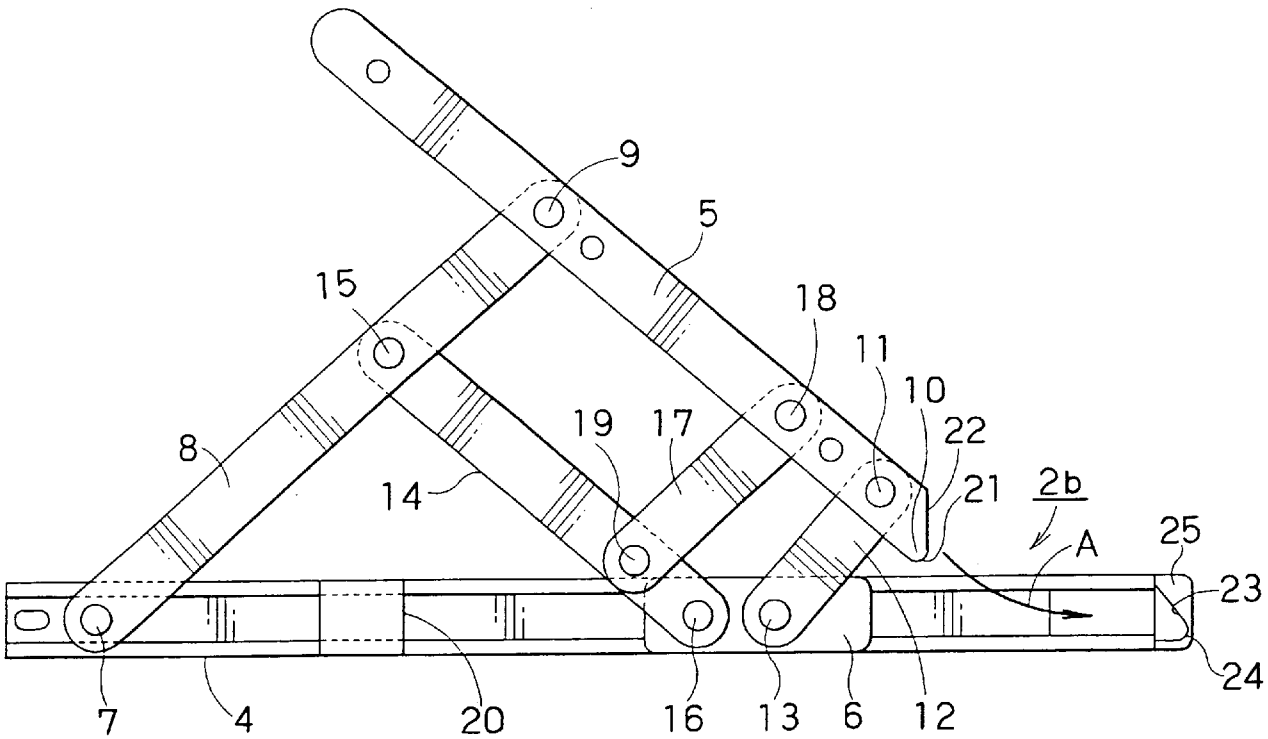
PRIOR ART FIG. 5
FIG. 5 is a plane view showing a conventional window stay.

As shown in FIGS. 1, 2 and 3A, an engaging projection 48 having side faces 48*a* is disposed at the center of the top end of the bar member 37 and extends in a longitudinal direction of the bar member 37. An insert groove 49 extends in the longitudinal direction of the track member 30 and is disposed at the center of the end portion of the track member 30 so that when the bar member 37 moves to the position where it overlies the track member 30, the engaging projection 48 can enter. The insert groove 49 is formed in a receiving member 50 fixed on the track member 30. Alternatively, the receiving member 50 and the track member 30 may be integrated.

Referring to FIGS. 3A, 3B, a guide wall 51 widening in the transverse direction of the track member 30 is formed at the front portion of the insert groove 49 in order to securely fit the engaging projection 48 into the insert groove 49. The guide wall 51 has sloping surfaces 52 symmetrical about a central part of the guide wall such that the insert groove side becomes narrow in relation to the transverse direction of the track member 30. The sloping surfaces 52 of the guide wall 51 continue to side surfaces 49*a* of the insert groove 49 via corner sections 49*b*. The corner sections 49*b* may be curved in an arcuate shape (not shown). In FIG. 3A, the insert groove 49 is open at both ends. However, in an alternative embodiment shown in FIG. 3(B), a wall 53 may be provided at the outward end portion to close the open end.

Since the guide wall 51 is open in the transverse direction of the track member 30, the engaging projection 48 can be guided by the sloping surfaces 52 and enter the insert groove 49 even if the engaging projection 48 abuts any one of the sloping surfaces 52 of the guide wall 51. By this construction, the engaging projection 48 is securely supported in the insert groove 49 in such a state that the side surfaces 48*a* of the engaging projection 48 face the side surfaces 49*a* of the insert groove 49.

The periphery of the top end of the engaging projection 48 and the sloping surface 52 of the guide wall 51 may preferably be curve-shaped so that when the engaging projection 48 contacts the guide wall 51, the contact point makes a line contact. Alternatively, the contact between the engaging projection 48 and the guide wall 51 may preferably be a surface contact.

The width of the insert groove 49 is preferably a little larger than the width of the engaging projection 48 so that when the engaging projection 48 enters the insert groove 49 or slips out of the insert groove 49, movement of the engaging projection 48 can be made smoothly. However, if the width of the insert groove 49 is too large as compared to the width of the engaging projection 48, the window will tend to shake. Thus, the width of the insert groove 49 is preferably made as small as possible so long as the movement of the engaging projection 48 is not obstructed. The length of the engaging projection 48 is appropriately adjusted so that it does not interfere with the above operation.

As indicated by a dash-double-dot line in FIG. 3(A), the engaging projection 48 can be inserted and removed from either side of the insert groove 49. Accordingly, the bar member 37 connected to the track member 30 by means of the first arm 35 can be moved to the upper side of the track member 30 as shown in FIG. 1 by rotating the first arm 35 counterclockwise, or to the lower side of the track member 30 by rotating the first arm 35 clockwise (not shown). Then, the bar member 37 can be moved from either side to the position where it overlies the track member 30.

When the engaging projection 48 enters the insert groove 49, the engaging projection 48 abuts the guide wall 51, and by the guide wall 51, movement of the bar member 37 having the engaging projection 48 thereon can be controlled. Since the bar member 37 moves while the engaging projection 48 is kept in the insert groove 49, the bar member 37 can be drawn toward the track member 30 and the window can be tightly closed.

When the window is opened, since the bar member 37 starts to rotate around the engaging projection 48 which is fitted to the insert groove 49 of the track member 30, movement of the bar member 37 is smooth. In addition, the engaging projection 48 is guided by the insert groove 49 and moves in the longitudinal direction of the track member 30, by which the slide member 32 can be moved in the longitudinal direction via the second arm 39 and smooth operation can be made without creating a locked state.

Thus the present invention provides a window stay having a track member for connection to a window frame, a bar member for connection to a window, a slide member slidably mounted on the track member, a first arm connecting the track member to the bar member and a second arm connecting the bar member to the slide member. The first and second arms can move the bar member to a closed position where the bar member overlies the track member and to an open position where the bar member is slidingly moved away from the track member. An engaging projection is disposed at the center of the top end of the bar member. An insert groove is formed at the center of the end portion of the track member to which the engaging projection can be inserted when the bar member is moved to the closed position where it overlies the track member. A receiving member has a guide wall formed at the front portion of the insert groove for guiding the engaging projection to the insert groove. By this construction, the engaging projection formed at the center of the top end of the bar member can be inserted into the insert groove provided at the center of the end portion of the track member and can be moved away from the insert groove from either side of the track member, whereby it is possible to employ window stays having the same structure at the upper and lower or right and left sides of the window.

Further, by the guide wall of the receiving member, the movement of the engaging projection entering the insert groove can be restricted and the opening and closing of the window can be controlled, whereby it is possible to draw the window to the window frame via the bar member and to obtain a window which provides an air tight closure and which does not shake in a closed state. Moreover, when the window is opened, since the bar member starts to rotate around the engaging projection fitted to the insert groove, no locked state is created during the opening and closing movements and the window can be opened and closed smoothly.

Moreover, when the control arm is provided between the second arm and the slide member, at the position where the window is open, it is possible to prevent the bar member from further rotating around the axis around which the first arm is pivotally mounted, thereby ensuring safety.

A window construction according to the present invention uses a pair of the window stays described above for adjustably mounting a window in a window frame. The window stays can be connected at any one of the upper and lower or right and left positions of the window so that the window can be opened and closed smoothly without causing a locked state.

From the foregoing description, it can be seen that the present invention provides an improved window stay and an improved window construction. It will be appreciated by those skilled in the art that obvious changes can be made to the embodiments described in the foregoing description without departing from the broad inventive concept thereof. It is understood, therefore, that this invention is not limited to the particular embodiments disclosed but is intended to cover all obvious modifications thereof which are within the scope and the spirit of the invention as defined by the appended claims.

We claim:

1. A window stay comprising: a bar member; a track member; a slide member slidably mounted on the track member; a pair of arms for moving the bar member to a closed position and to an open position, the pair of arms having a first arm connecting the track member to the bar member and a second arm connecting the bar member to the slide member so that the bar member overlies the track member in the closed position and is slidingly moved away from the track member in the open position; a projection disposed on the bar member and having a pair of generally parallel side surfaces extending in a longitudinal direction of the bar member; and an insert groove formed at an end portion of the track member for receiving the projection when the bar member is in the closed position, the insert groove having a guide wall for guiding the projection into the insert groove and a pair of generally parallel side surfaces extending in a longitudinal direction of the track member.

2. A window stay according to claim 1; wherein the guide wall of the insert groove widens in a direction transverse to a longitudinal direction of the insert groove.

3. A window stay according to claim 2; further comprising a receiving member mounted at the end portion of the track member, the receiving member having the insert groove and the guide wall for receiving the projection.

4. A window stay according to claim 1; further comprising a receiving member mounted at the end portion of the track member, the receiving member having the insert groove and the guide wall for receiving the projection.

5. A window stay according to claim 1; further comprising a control arm disposed between the second arm and the slide member for restricting an opening angle of the second arm.

6. A window stay according to claim 1; wherein the projection is disposed at a central portion of the top end of the bar member.

7. A window stay according to claim 1; wherein the insert groove is disposed at a central portion of the top end of the track member.

8. A window stay according to claim 1; wherein the guide wall is formed at a front portion of the insert groove.

9. A window stay according to claim 1; wherein the side surfaces of the projection are generally parallel to the side surfaces of the insert groove when the bar member is in the closed position.

10. A window construction comprising: a window; a window frame; and a pair of window stays each according to claim 1 for adjustably mounting the window in the window frame.

11. A window construction according to claim 10; wherein the track member of each of the stays is connected to the window frame and the bar member of each of the stays is connected to the window.

12. A window stay comprising: a track member; a bar member having a projection having a pair of generally parallel side surfaces extending in a longitudinal direction of the track member; connecting means for connecting the bar member and the track member to one another and for moving the bar member to an open position and to a closed position; and receiving means disposed on the track member for receiving the projection of the bar member when the bar member is in the closed position and for controlling movement of the bar member to the open and closed positions, the receiving means comprising a receiving member having an insert groove for receiving the projection of the bar member, the insert groove having a pair of generally parallel side surfaces extending in a longitudinal direction of the track member and a guide wall for guiding the projection into the insert groove to thereby control movement of the bar member to the open and closed positions.

13. A window stay according to claim 12; further comprising a slide member slidably mounted on the track member; and wherein the connecting means comprises a first arm connecting the track member to the bar member and a second arm connecting the bar member to the slide member so that the bar member overlies the track member in the closed position and is slidingly moved away from the track member in the open position.

14. A window stay according to claim 13; further comprising a control arm disposed between the second arm and the slide member for restricting an opening angle of the second arm.

15. A window stay according to claim 12; wherein the guide wall of the insert groove widens in a direction transverse to a longitudinal direction of the insert groove.

16. A window stay according to claim 12; wherein the insert groove is disposed at a central portion of an upper end of the track member.

17. A window stay according to claim 16; wherein the projection is disposed at a central portion of an upper end of the bar member.

18. A window stay according to claim 12; wherein the guide wall is formed at a front portion of the insert groove.

19. A window stay according to claim 12; wherein the side surfaces of the projection is generally parallel to the side surfaces of the insert groove when the bar member is in the closed position.

20. A window construction comprising: a window; a window frame; and a pair of window stays each according to claim 12 for adjustably mounting the window in the window frame.

21. A window construction according to claim 20; wherein the track member of each of the stays is connected to the window frame and the bar member of each of the stays is connected to the window.

22. A window stay comprising: a bar member; a track member; a slide member slidably mounted on the track member; a pair of arms for moving the bar member to a closed position and to an open position, the pair of arms having a first arm connecting the track member to the bar member and a second arm connecting the bar member to the slide member so that the bar member overlies the track member in the closed position and is slidingly moved away from the track member in the open position; a projection disposed on the bar member and having a pair of generally parallel side surfaces extending in a longitudinal direction of the bar member; and an insert groove formed at an end portion of the track member for receiving the projection when the bar member is in the closed position, the insert groove having a pair of generally parallel side surfaces extending in a longitudinal direction of the track member.

23. A window stay according to claim 22; wherein the side surfaces of the projection are generally parallel to the side surfaces of the insert groove when the bar member is in the closed position.

24. A window construction comprising: a window; a window frame; and a pair of window stays each according to claim 22 for adjustably mounting the window in the window frame.

25. A window construction according to claim 24; wherein the track member of each of the stays is connected to the window frame and the bar member of each of the stays is connected to the window.

* * * * *